US005958528A

United States Patent [19]

Bernecker

[11] Patent Number: 5,958,528

[45] Date of Patent: Sep. 28, 1999

[54] DATA CARRIER AND METHOD FOR PRODUCTING IT

[76] Inventor: Otto Bernecker, Rudi-Ismayr-Str. 19, 85375 Neufahrn, Germany

[21] Appl. No.: 08/575,034

[22] Filed: Dec. 19, 1995

[30] Foreign Application Priority Data

Dec. 21, 1994 [DE] Germany ..... 44 45 822

[51] Int. Cl.[6] ..... B42D 15/02

[52] U.S. Cl. ..... 428/29; 428/195; 428/203; 428/204; 428/211; 430/10; 430/14

[58] Field of Search ..... 428/29, 195, 203, 428/204, 211; 430/10, 14

[56] References Cited

FOREIGN PATENT DOCUMENTS

| | | |
|---|---|---|
| 0 372 274 A2 | 6/1990 | European Pat. Off. . |
| 0 518 363 A1 | 12/1992 | European Pat. Off. . |
| 0 523 304 A1 | 1/1993 | European Pat. Off. . |
| 29 07 004 C 2 | 6/1981 | Germany . |
| 3048 733 A1 | 7/1982 | Germany . |
| 3151 407 C 1 | 10/1983 | Germany . |

*Primary Examiner*—Richard Weisberger
*Attorney, Agent, or Firm*—Gottlieb, Rackman & Reisman, P.C.

[57] ABSTRACT

The invention relates to a data carrier, such as an identity card, credit card or the like, with at least one plastic layer having first diffusely light-scattering properties at least in a partial area due to its surface quality. In this area information is provided by means of a laser in the form of local changes of surface quality which have second diffusely light-scattering properties so that the information is readable at least at a certain viewing angle but has no color contrast with its surroundings.

19 Claims, 1 Drawing Sheet

DATA CARRIER AND METHOD FOR PRODUCTING IT

This invention relates to a data carrier, such as an identity card, credit card or the like, with at least one plastic layer having information incorporated in certain areas with the help of a laser, as well as to a method for producing it.

The data carriers in question here are any information carriers with visually readable data, such as calling cards or labels, etc. However the invention relates specifically to identification documents, such as identity cards, chip cards, passports or the like, which have not only general information but also individual, mostly user-related, information. The latter is usually data such as name, date of birth, signature and photo of the user. These individual data must be protected against manipulation and forgery. The increasing spread of high-quality, inexpensive reproduction methods and devices, such as scanners, color copiers or CAD systems, makes it ever easier to produce remarkably good imitations of authentic identity cards, so that new and technically more elaborate authenticity features must constantly be developed. In recent years hologram-like surface structures have primarily been used as an authenticity criterion since they provide a visually striking, optically variable color effect which cannot be reproduced by copying machines. Furthermore the danger of simulacrum counterfeits is very low since the production of holograms is very expensive and also requires considerable technical know-how.

On the other hand, precisely this fact means that such an effort is economically unreasonable for certain products, in particular if they are produced in small piece numbers.

The hologram structures are therefore very frequently produced separately as embossed transfer holograms and transferred to the data carrier in certain areas under the action of heat and pressure. Although the layer thicknesses of the hologram elements are very small, it is possible with skillful handling to detach such a layer structure from an authentic document and transfer it to a false one.

In connection with passports an authenticity feature has become known (EP 0 523 304 A1) which does not have this disadvantage and furthermore produces a visual effect not reproducible by copying machines. One provides in the passport, along with the usual data page laminated with at least one plastic film, a further plastic film in which a color layer is embedded at least in a partial area. The photo of the passport owner which is glued on the data page serves as an original for a mechanical engraving in the color layer, so that the picture information is present in the finished passport twice, once as an exposed film, i.e. a normal photo, and once in the form of an engraving.

EP 0 518 363 A1 discloses a similar procedure, the only difference being that the picture information is engraved in a special layer structure, so that the picture is hardly visible by reflected light but readily visible by transmitted light. In the simplest case the layer structure consists of a plastic layer with a certain opacity which is covered by an engraving layer, i.e. a color layer with higher opacity.

The data to be protected, in this case the photo, can be falsified rather easily by replacing the photo, but the practically unalterable engraving offers a good possibility of exposing such an attempt at forgery.

However the production method for such a passport is very elaborate due to the additional engraving, since before the passport is bound the original photo to be glued in must be scanned pixel by pixel and converted into motion of the graver directly by electronic means. Following the engraving process a fixed association must be guaranteed between original photo, engraved passport page and any further individualized data pages until the passport is finally bound.

Furthermore very fine gravers must be used for this method to guarantee sufficient image quality, and such gravers are subject to high wear. Also, this wearing process takes place continuously, so that this method fails to provide constant engraving quality.

The invention is therefore based on the problem of providing a data carrier, as well as a method for producing it, which has an authenticity feature that is neither manipulable nor copiable and can be produced simply and cost-effectively on the finished product.

This problem is solved by the features of the independent claims. Developments are the object of subclaims.

The invention is based on the finding that the surface quality of a plastic film can be altered by means of a suitably controlled laser without producing discolorations in the plastic material. This gives rise to areas with different light scattering properties which possibly cannot be recognized visually when viewed by reflected light and stand out clearly only when viewed at the glancing angle. The laser's action of heat can for example roughen smooth surfaces, smooth rough surfaces, cloud transparent materials, clarify cloudy materials or remove whole layer areas.

Laser inscription with its many-sided advantages has long been part of common practice in personalizing identity documents (DE 29 07 004 C2, DE 30 48 736 A1, DE 31 51 407 C1). Since one of the main problems in this field is forgeryproof application of personal data, however, this technology has been discussed and developed exclusively from the point of view of producing clearly readable information contrasting with its surroundings in the form of discolorations of the material.

The removal of color layers with the help of a laser has also been discussed in this connection. DE 30 48 733 A1, for example, describes an identity card provided with several layers of different colors. Personalization takes place by selective layer removal, so that the color layers located under the uppermost color layer become visible and make the information legible due to their contrast with the other color layers. Since this method necessitates several removal processes to obtain complete removal of the individual layers, however, EP 0 372 274 A1 proposes disposing a transparent, laser-sensitized layer of lacquer between the individual color layers to be able to compensate tolerances in the layer thicknesses. When exposed to laser light part of the layer of lacquer is thermally degraded so that the color layer there-above is removed along with the layer of lacquer in the radiation-exposed area. After inscription of the data carrier one recognizes the subjacent color layer through the partly removed layer of transparent lacquer.

In contrast, it is an essential feature of the invention that the material processing by the laser takes place without discoloration of the substrate material and without producing color contrast with the surroundings.

According to a preferred embodiment a single- or multilayer plastic identity card with a smooth surface is provided in a certain area with a microrelief in the form of characters, patterns or the like. The laser, its power and the plastic material must be coordinated with one another in such a way that the plastic material is not discolored by the action of the laser. The microrelief has such a fine structure that it cannot be recognized by reflected light and appears only at the glancing angle.

Conversely, the identity card can also be provided with a rough surface structure in a partial area during the laminating process by providing the laminating plates with the negative structure at the corresponding place and thus embossing the relief on the cover film. During incorporation of the security feature the radiation-exposed areas are softened by the laser's action of heat so that the relief structure gets lost in these areas and the surface of the card is smoothed. This information is also visible chiefly at the glancing angle.

These differences in optical scattering behavior cannot be recognized with the illuminating methods customarily used in reproduction devices. Such effects are generally not adjustable with these methods either.

According to a further embodiment the externally accessible plastic film of a data carrier is engraved in the form of characters or patterns, i.e. the plastic material is evaporated with the help of the laser so that depressions arise in the plastic material in the form of readable information.

This manner of marking can be used advantageously in particular in the production of passports. In this case at least parts of the personalization data which are produced in the form of a color contrast and are thus easily readable are provided on the document once again in the form of a colorless laser engraving. The engraving can be disposed for example directly under or over the particular printed or color-contrasting lasered information to permit a quick comparison of the two pieces of information.

It is likewise conceivable to dispose the engraved information on a separate information carrier. This is useful in particular with book-shaped passports which already contain several data sheets. One can thus provide, along with the usual laser-inscribed data sheet, a further data sheet made of plastic or laminated with a plastic film in which at least parts of the user-related data record, e.g. the photo of the owner, are engraved by removal of material with a laser. The plastic film can in this case have any opacity. If it is transparent the engraved information can be easily read chiefly at the glancing angle. If opaque or translucent films are used a watermark effect can also be produced by providing the plastic film with a color layer or plastic film with higher opacity before engraving. This makes the engraving hardly visible by reflected light but clearly recognizable when viewed by transmitted light due to the areas differing in transparency.

Laser engraving has the decisive advantage over mechanical engraving that it can produce engravings of constant high quality since no wearing parts such as gravers are required. Furthermore, it can be performed on the finished passport document.

The production of the inventive authenticity feature can be integrated very advantageously into the inscription process of the data carrier, in particular if the data carrier is already inscribed in color contrast by a laser. For inscribing identity documents all user-related data, such as photo, name, signature, etc., are usually combined into one digital data record which is finally used for controlling the various information output devices used, such as laser printer, ink jet printer, laser beam, etc. In the invention the information to be shown without color contrast is added to this data record. If certain parts of the original data record are to be provided on the data carrier once again in the form of differently light-scattering areas, they must be provided with a marking which ensures a new lasering of these data with another laser.

One might also consider using one and the same laser, e.g. an Nd:YAG laser, for the contrasting laser inscription and the colorless lasering. It is known from the field of contrasting laser inscription that discoloration occurs only as of a certain laser power, becomes stronger as the laser power increases further, and finally leads to complete burning of the material. Using a power-controllable laser it is therefore possible to produce halftone images. The laser beam is adjusted via optical systems so that its focus is located in the volume of the plastic material. If the focus position is shifted to the surface area of the material, i.e. its length shortened, the material in the radiation-exposed areas is melted and partly decomposed, giving rise to notches without color changes of the plastic.

However, any other types of laser can also be used, such as $CO_2$ or excimer lasers. Which laser is most suitable for processing which substrate material depends greatly on the parameters of decomposition energy of the substrate material, laser power and type of laser (e.g. pulsed or continuously operated laser). These parameters must therefore be optimized experimentally for each specific case of application.

The invention can be used advantageously not only whenever a security feature is to be provided for protection against forgery. The invention also offers a simple possibility for designing data to be very inconspicuous. For example manufacturer's data, which basically disturb the layout of the document and whose content is of little interest to the general public, can be simultaneously incorporated without complication during personalization of the documents. They hardly appear by reflected light and are in any case readily recognizable at the glancing angle.

Further embodiments and advantages of the invention will be explained in the following with reference to the figures, in which.

Figure 1:
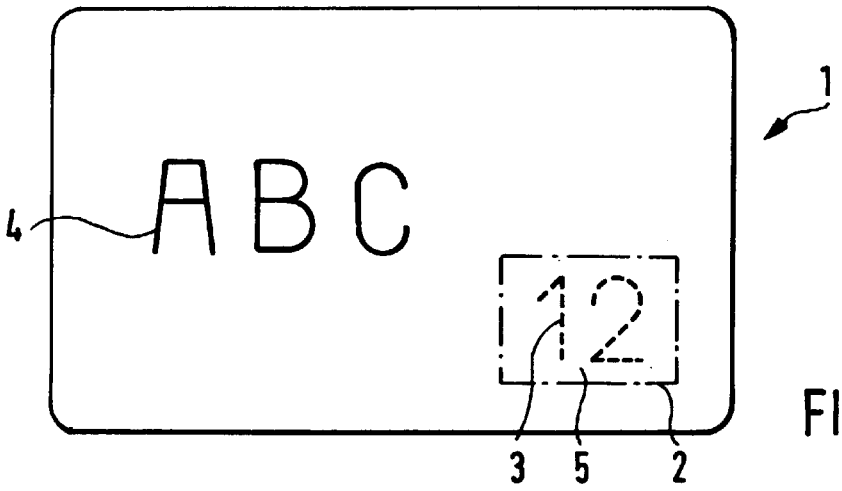
FIG. 1 shows a data carrier according to the invention.

FIG. 1 shows a data carrier according to the invention. The identity card shown can be of single- or multilayer design and has in any case an externally accessible plastic layer. Along with usual information 4 shown in color contrast and relating to the issuing authority and the user, card 1 has authenticity feature 2. Area 5 has first diffusely light-scattering properties due to its surface quality. Area 5 is interrupted by areas 3 which show readable information or a pattern or the like and have a different surface quality from surroundings 5. Information 3 therefore also has different diffusely light-scattering properties which make it possible to recognize the information clearly at a certain viewing angle.

Data carrier 1 can of course also have further security features or an integrated circuit. Such an identity card can likewise be contained in a book-shaped passport.

Personalization data 4 are preferably incorporated with a laser in the form of discolorations of the plastic material. During personalization of the data carrier information 3 is incorporated additionally with the help of the same or a different laser by altering the original surface quality of data carrier 1. This can be done in a great variety of ways, as will be explained more closely in the following.

Figure 2:
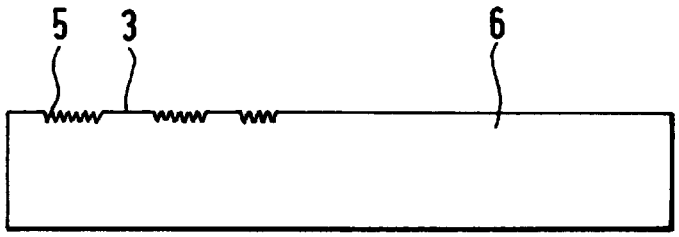
FIG. 2 shows an embodiment of the inventive security feature.

FIG. 2 shows a variant of inventive data carrier 1 in cross section, indicating only plastic layer 6 to be processed. Under layer 6 there may of course be further plastic or paper layers.

In the example shown, the plastic film was provided in a first step with roughened surface area 5, e.g. with the help of the laminating plates or by simply embossing a surface structure. Subsequently area 5 was exposed at certain places 3 to a laser coordinated with the material. The laser's action of heat softens plastic material 6 in areas 3. The soft material loses the embossed structure, the relief areas even out, and relatively uniform smooth areas 3 arise.

Figure 3:
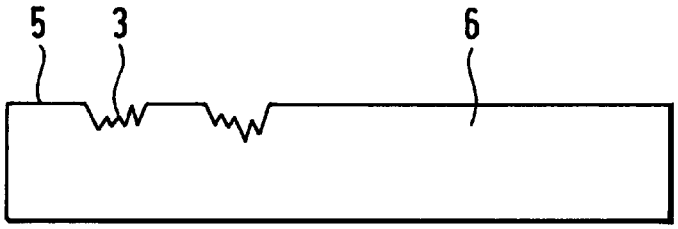
FIG. 3 shows a further embodiment of the inventive security feature.

FIG. 3 shows a further embodiment of inventive data carrier 1. Here, surface area 5 of plastic material 6 has a homogeneously smooth surface, while information 3 is incorporated in the material in the form of a laser engraving. Alternatively, the material can also be melted in the surface area without any discoloration of the material occurring.

It is likewise possible to design the plastic layer not as a film but as a layer of lacquer on a carrier layer.

I claim:

1. A data carrier with at least one plastic layer bearing information, said carrier comprising:

a first and a second area formed on said plastic layer, said first and a second areas having different light scattering properties and no color contrast, said light scattering properties of at least one of said first or second area being generated by a laser light.

2. The carrier of claim 1 wherein said layer is defined by said first , said second and a remaining area, said first and second areas having no color contrast with said remaining area.

3. The data carrier of claim 1 wherein said first and second areas have respective surface roughness wherein the surface roughness of the first area is different to the surface roughness of the second area.

4. The data carrier of claim 1, wherein said second area is shaped to define one of a predetermined alphanumeric character and a pattern.

5. The data carrier of claim 1 wherein a portion of said layer has been removed to define said information.

6. The data carrier of claim 1 further comprising one of a color layer and a plastic film overlaying said plastic layer having a higher opacity than the plastic layer, and in which the information is present congruently to that in the plastic layer.

7. The data carrier claim 1 wherein said second area forms a microrelief which has a fine structure that is not visible by reflected light and appears only at a glancing angle.

8. The data carrier of claim 1 wherein the data carrier has further readable information which is applied in the form of a color contrast resolvable by the eye.

9. The data carrier of claim 1 wherein the data carrier is a single-layer identity card.

10. The data carrier of claim 8, wherein the data carrier is a passport and the further information is present at least partly on a first data page of the passport.

11. The data carrier of claim 10, wherein the first and second areas are present on the first data page of the passport.

12. The data carrier of claim 10, wherein the first and second areas are present on a second data page of the passport.

13. The data carrier of claim 1, characterized in that the information is at least partly identical in content to a second information produced by a color contrast.

14. The data carrier of claim 1 wherein the plastic layer is a layer made of one of a lacquer and a plastic film.

15. A method of producing a data carrier comprising the steps of:

providing a plastic layer;

applying a laser beam to said plastic layer in a first way to form a first area on said plastic layer; and applying said laser beam to said plastic layer in a second way to form a second area on said plastic layer, said first and second areas having different light scattering properties to define information on said plastic layer;

wherein said laser bean is applied at a laser power, said laser power being varied between said first and second way without discoloring said plastic layer while said first and second areas are formed.

16. The method of claim 15 wherein said laser beam is generated by one of an Nd:YAG,$CO_2$ and an excimer laser.

17. The method of claim 15, further comprising the step of using said laser to apply further information in the form of discolorations or burnings of material.

18. The method of claim 15 wherein the plastic layer is smoothed, melted or partly removed by the laser beam.

19. The data carrier of claim 1, wherein said areas are only distinguishable from a glacing angle.

* * * * *